United States Patent [19]

Koblick

[11] 4,118,032

[45] Oct. 3, 1978

[54] GOLF PRACTICE DEVICE

[75] Inventor: Jeffrey Koblick, Hopkins, Minn.

[73] Assignee: K-tel International, Inc., Minnetonka, Minn.

[21] Appl. No.: 797,522

[22] Filed: May 16, 1977

[51] Int. Cl.[2] ..... A63B 69/36

[52] U.S. Cl. ..... 273/185 C; 273/200 R

[58] Field of Search ..... 273/185 C, 184 B, 185 D, 273/196, 197 R, 197 A, 198, 200 R

[56] References Cited

U.S. PATENT DOCUMENTS

| | | | |
|---|---|---|---|
| 1,857,267 | 5/1932 | Tyler et al. | 273/185 C |
| 2,201,697 | 5/1940 | Martin et al. | 273/185 C |
| 3,031,889 | 5/1962 | Magazanik et al. | 273/185 C |
| 3,430,493 | 3/1969 | Wall | 273/184 B X |
| 4,014,552 | 3/1977 | Watson | 273/185 C |

*Primary Examiner*—George J. Marlo

*Attorney, Agent, or Firm*—Allegretti, Newitt, Witcoff & McAndrews

[57] ABSTRACT

An improved portable golf practice device includes a base with a pivotably attached arm. A freely slidable distance indicator and a spring biased slidable yoke are mounted on the arm. The yoke is mounted for pushing the indicator away from the point at which the arm pivots on the base. A cord and ball are attached to the yoke. When the ball is struck, it pulls the yoke against the force of the spring which biases the yoke and causes the distance indicator to slide along the arm away from the pivot. A distance scale formed in the base indicates the distance the distance indicator travelled and thus indicates the distance the ball would travel if unattached. The device also includes an angle indicator member on the arm which cooperates with an angle scale on the base to indicate the direction of flight of the golf ball.

3 Claims, 13 Drawing Figures

Fig. 4
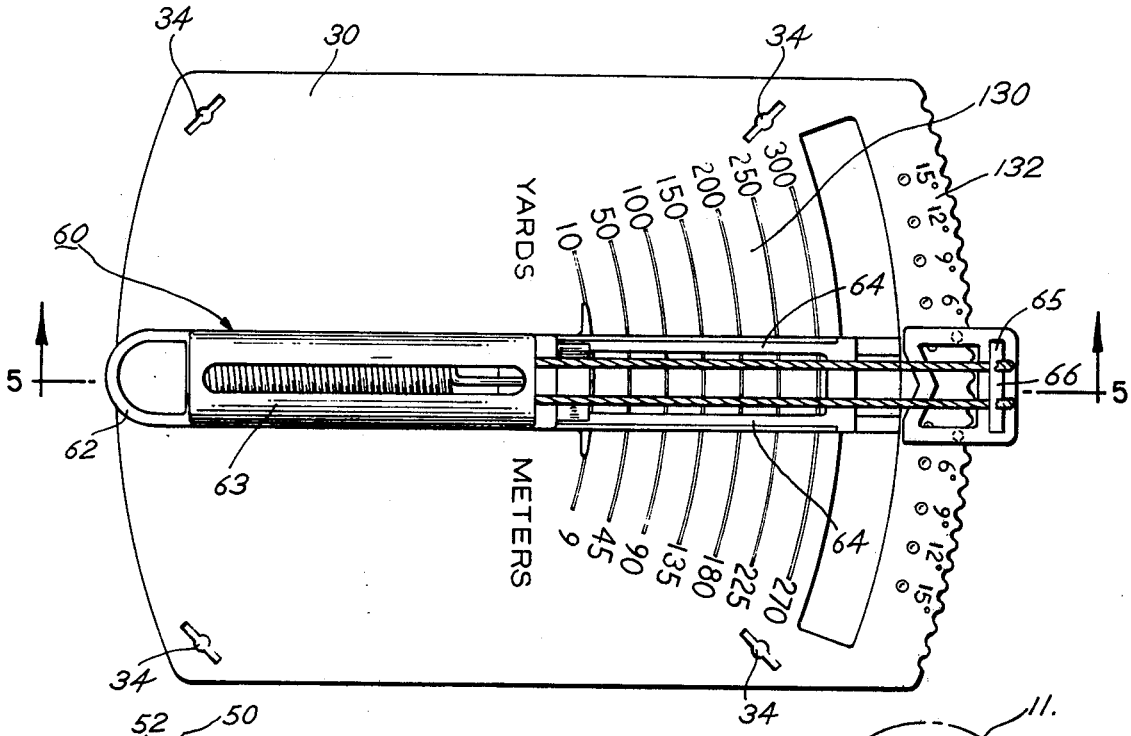
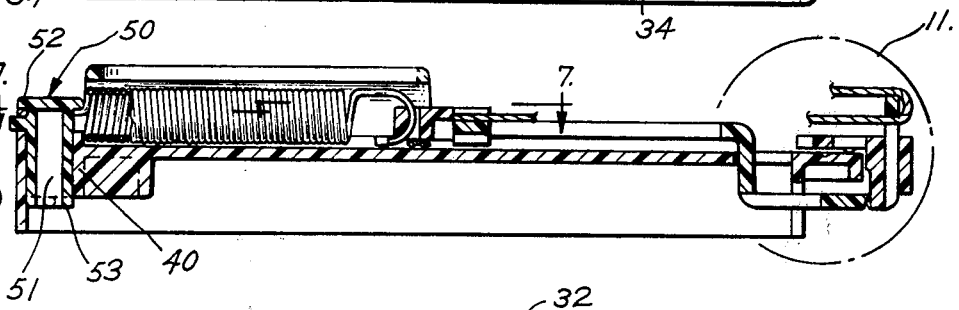
Fig. 5
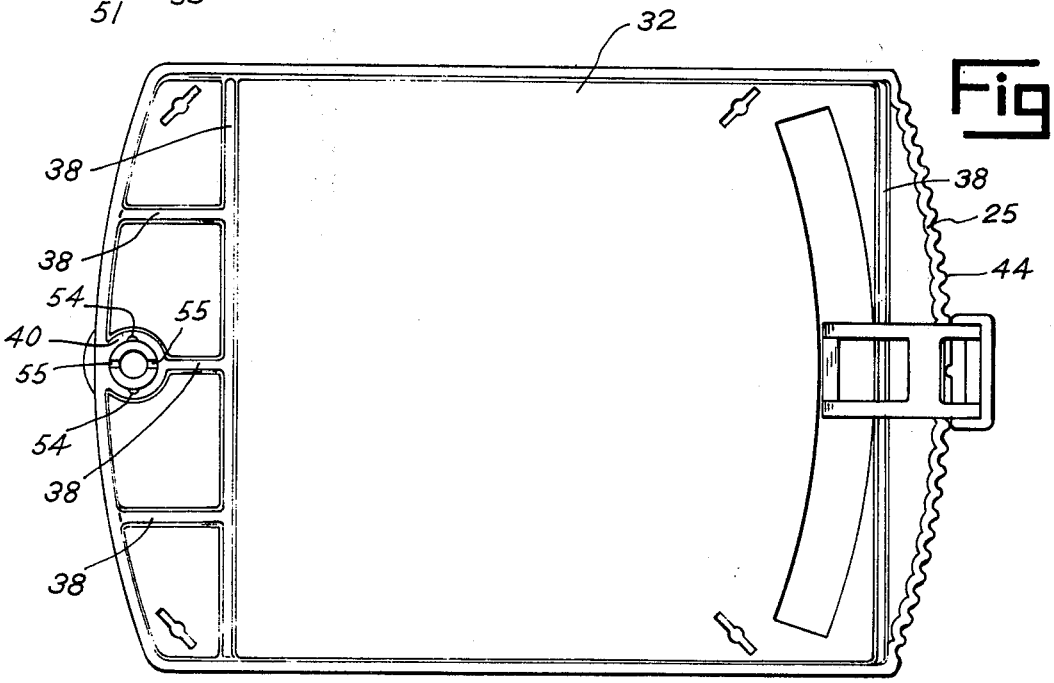
Fig. 6

GOLF PRACTICE DEVICE

BACKGROUND OF THE INVENTION

The present invention relates generally to a golf practice device and, more particularly, to an improved golf practice device designed to help golfers improve and maintain their driving skills by realistically reproducing for them the conditions of actual play in private areas, while measuring for them the distance and accuracy of their practice drives.

The game of golf has long been a popular sport in many countries, challenging golfers to acquire and maintain skills including good form and consistency. Practice has always been necessary for playing well, and a variety of teaching and practice aids have been available in the past, including driving ranges, plastic practice balls, and home practice devices. One known practice device has a rectangular metal base with a steel rod mounted thereon for horizontal pivoting. At its free end, the rod is formed in a loop and passes between two vertically spaced steel retainers which are bolted across the front of the base. A steel yoke and a rubber ring are formed to travel along the rod, the rubber ring going ahead of the yoke. Attached to the yoke is a nylon rope which passes through the loop on the rod and has a golf ball secured to its other end. A length of stretchy cord is positioned across the back of the base, and is bolted at its ends to the corners of the base. This cord passes through the yoke. Two lengths of the same stretchy cord are positioned across the front of the base, crossed through the loop of the rod and bolted to the corners of the base. An illustration of this device is set forth in FIG. 13.

The device just described is operated by spiking the base to the ground, placing the ball a distance behind the base and driving the ball over the base. When the ball reaches the end of the rope, it pulls the yoke and the ring along the arm, stretching the back cord. If the ball has travelled at an angle, the rod pivots toward the direction of flight against the resistance of the front and back cords. When the energy of the ball has been spent by the stretching of the cords, the back cord recoils, returning the yoke to its starting position on the rod. The rubber ring stays in the position to which it was pushed, and the arm remains pivoted off-center. Thus the distance and angle of the practice drive are respectively measured by the distance the ring has travelled and by the angle the arm has pivoted.

SUMMARY OF THE INVENTION

In a principal aspect, the present invention comprises an improved portable golf practice device for developing golf swings in private, relatively restricted areas under realistic conditions. The device includes a base and a pivotal arm mounted on the base at a pivot. A distance indicator is mounted on the arm and is slidable toward and away from the pivot. A yoke is mounted on the arm and is also slidable toward and away from the pivot. The yoke is mounted for engaging the distance indicator and pushing it away from the pivot. Attached to the yoke for biasing it toward the pivot is a spring which is coaxially aligned with the axis of the arm. A cord is attached to the yoke and a golf ball is attached to the cord. Distance markings are provided on the base. These markings convert the distance that the distance indicator travels when the ball is struck into the distance the ball would travel if it were not restrained by the device.

The present invention may also include an angle indicator member on the arm, an angle scale on the base, and a mechanism for locking or holding the arm, which includes cooperating elements on the angle indicator member and on the base. The locking mechanism locks the arm in a plurality of pivotal positions, and upon vertical movement releases to allow the arm to pivot.

It is thus an object of the present invention to provide an improved portable golf practice device which permits a golfer to improve his or her swing, by recording the distance and angle the ball would travel from each drive if the golfer's swing were made in actual play.

Another object of the present invention is to provide a golf practice device which accurately and consistently gauges the distance the ball would travel if unrestrained, and does so regardless of any hook, slice, pull or push.

A further object of the present invention is to provide a device which accurately and consistently measures angles, and does so without being affected by the distance to which the ball is driven.

Still further objects are to provide a device enjoyable to use because it includes a real ball which flies when struck, which is mechanically streamlined, which is inexpensive for the consumer, and which has a rugged construction for safety and durability.

These and other objects and advantages of the present invention will become apparent from the description of the preferred embodiment of the invention which follows.

BRIEF DESCRIPTION OF THE DRAWING

The following is a description of the preferred embodiment, which is described in connection with the accompanying drawing, wherein:

FIG. 4 is a top plan view of the device shown in FIG. 1;

FIG. 5 is a vertical cross-sectional view taken along line 5—5 of FIG. 4;

FIG. 6 is a bottom plan view of the device shown in FIG. 1;

DESCRIPTION OF THE PREFERRED EMBODIMENT

Figure 1:
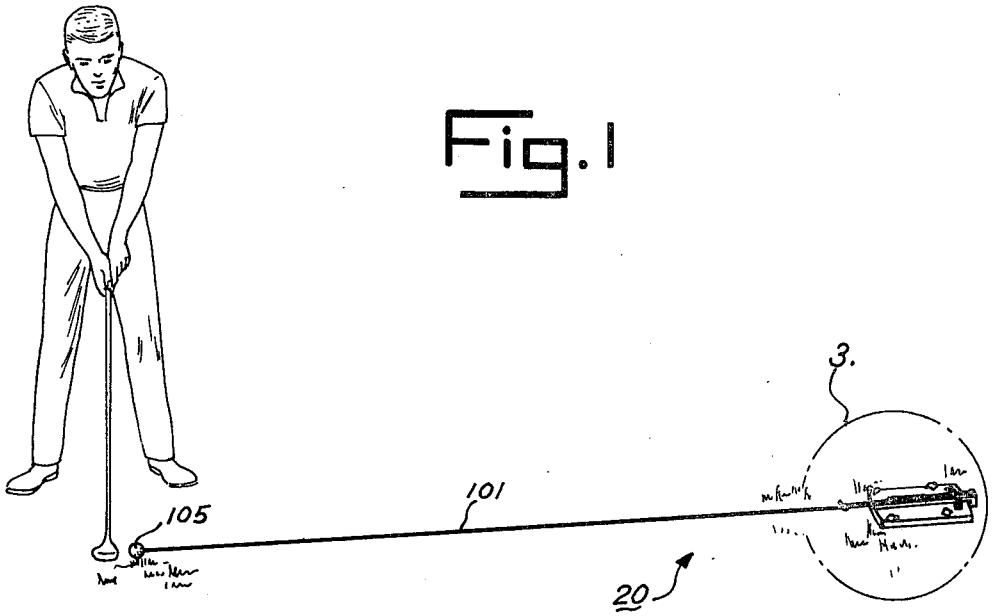
FIG. 1 is a perspective view of a preferred embodiment of the present invention shown with the ball placed behind the base on a tee ready to be struck.

Referring to the drawing, a preferred embodiment of the present invention is shown and generally designated as a golf practice device 20 in FIG. 1, and as noted above, is adapted to be utilized by golfers to practice their swings under realistic conditions and in private, somewhat restricted areas such as backyards or parks. Briefly, golf practice device 20 has components which include a body 22, a pivot pin 50, an indicator arm 60, a distance indicator 70, a yoke 80, a helical spring 90, an angle indicator 120, cord 101, and ball 105. When assembled, indicator arm 60 and helical spring 90 are pivotally secured to body 22 by pivot pin 50, distance indicator 70 and yoke 80 are slidably mounted on indicator arm 60, cord 101 is attached to yoke 80, ball 105 is attached to cord 101, and angle indicator 120 is mounted on indicator arm 60.

Figure 3:
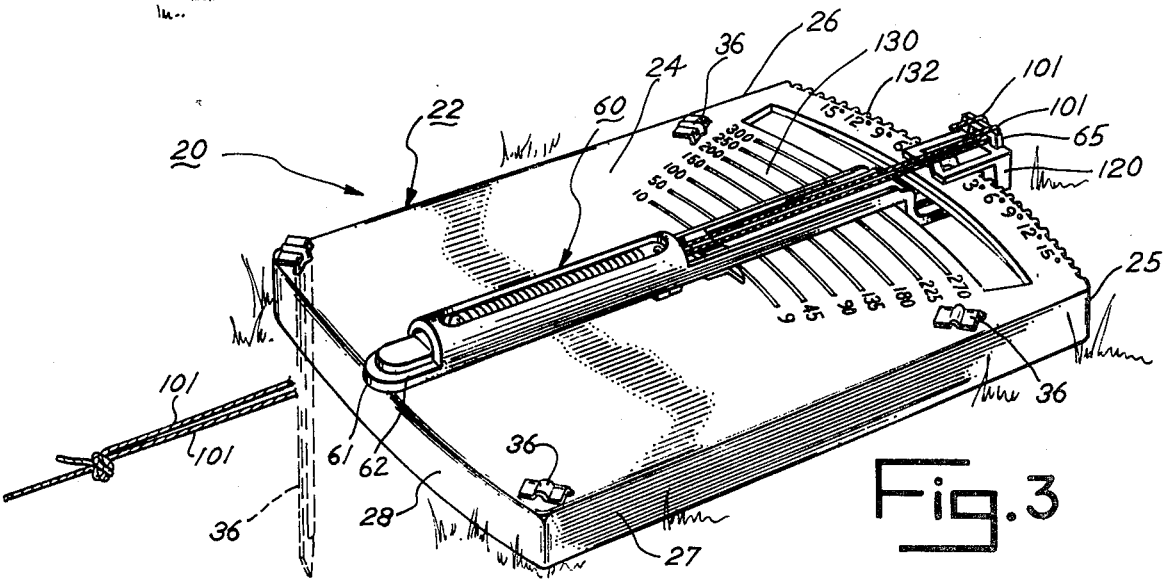
FIG. 3 is a close-up perspective view of the device as shown in FIG. 1.

Referring now to the specific details of the components of device 20, body 22 is shown in detail in FIG. 3, and includes a relatively thin, substantially rectangular base 24, an integrally molded front wall 25, side walls 26 and 27, and rear wall 28. When body 22 is secured to the ground, walls 26, 27, and 28 are in direct contact with the ground, while front wall 25 is shorter than the others and defines an opening through which arm 60 passes. Base 24 has substantially flat upper and lower surfaces 30 and 32, as shown in FIGS. 4 and 6, and a plurality of apertures 34 spaced about its periphery. Each of these apertures extends through the base and is adapted so that a peg 36 shown in FIG. 3 may be driven into the ground through the aperture to secure body 22 in position for use.

Figure 12:
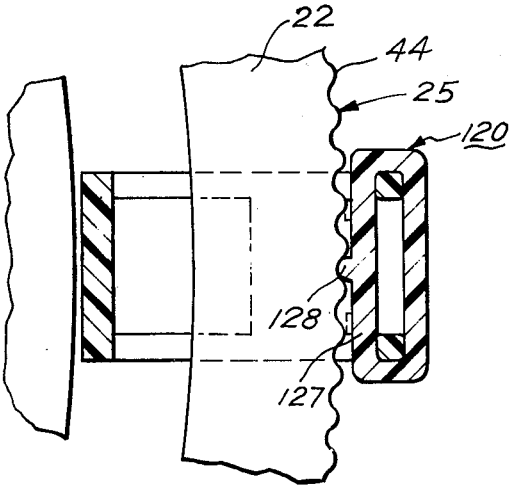
FIG. 12 is a partial horizontal cross-sectional view taken along line 12 of FIG. 11.
Figure 13:
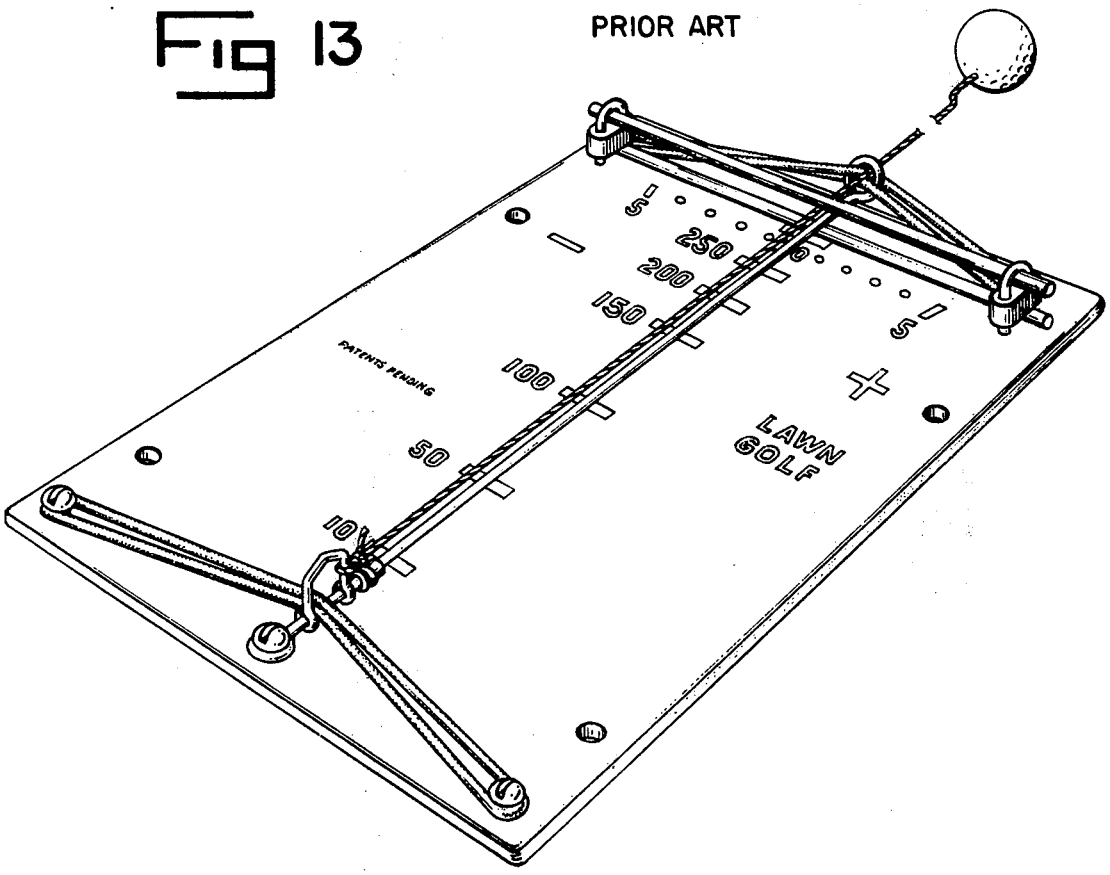
Fig 13 PRIOR ART

Adjacent front wall 25 a slot for arm 60 is defined in base 24. The slot extends from adjacent side wall 26 to adjacent side wall 27, and is curved along arcs of circles having centers along the central longitudinal axis of post 40. Arm 60 thus may pivot freely from side to side in the slot. Front wall 25 of body 22 is also curved along an arc of a circle having its center along the central longitudinal axis of post 40, and has a plurality of rounded vertical ribs 44 spaced along at least a portion thereof, as shown in FIGS. 6 and 12. These ribs cooperate with a rib on angle indicator 120 (described below) to releasably lock indicator arm 60.

An upright post 40 is integrally molded as part of body 22 for the mounting of arm 60 and spring 90. Post 40 is disposed on body 22 so that its central longitudinal axis is equidistant from side wall 26 and side wall 27 and adjacent rear wall 28. Body 22 has a plurality of braces 38 integrally molded with post 40, which extend below lower surface 32 to a distance less than that of walls 26, 27, and 28. Braces 38 provide extra rigidity and strength to body 22.

Base 24 further includes distance markings 130 between post 40 and slot 42, and angle markings 132 adjacent front wall 25. Distance markings 130, marked in yards or meters, provide the golfer with the distance he would have driven an unrestrained ball if he had hit it just as he hit the ball which is attached to the device. Actually the distance markings measure the travel of distance indicator 70. But since the travel of distance indicator 70 is directly related to the distance spring 90 is stretched, which distance is directly related to the energy of the driven golf ball member 105, distance markings 130 also reflect the energy of golf ball member 105. Since the energy of an unrestrained ball determines the length of its flight, the travel of distance indicator 70 can be converted to the distance an unrestrained ball would travel if hit with the same energy as a golf ball member 105. Distance markings 130 are calibrated to make this conversion for the golfer. As for angle markings 132, they simply measure the turn of indicator arm 60 from a selected reference line.

Referring now to FIGS. 5 and 6, molded plastic pivot pin 50 is shown disposed within post 40 and having a generally cylindrical shank 51 and a cap 52. Pivot pin 50 secures arm 60 and spring 90 to base 20, as noted above. Shank 51 is adapted so that it fits snugly within upright post 40, and has at its end 53 a plurality of buttons 54 extending radially outward therefrom and a plurality of longitudinal channels 55 spaced between the buttons. Buttons 54 are adapted to extend beyond the inner wall of post 40 when the pivot pin is positioned in post 40, and channels 55 are adapted so that the end 53 of shank 51 may be squeezed to a diameter small enough to permit buttons 54 to pass through post 40 when pivot pin 50 is pressed into place.

Figure 11:
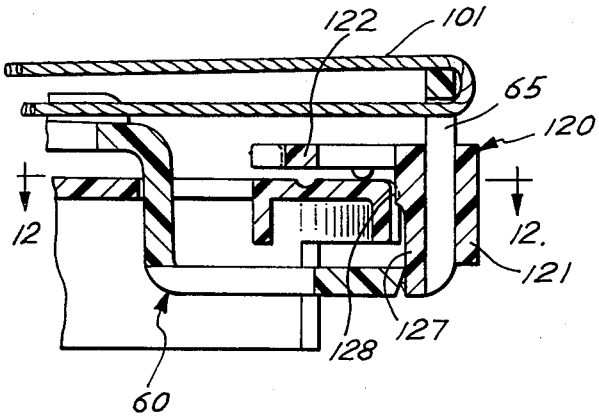
FIG. 11 is an enlarged partial vertical cross-sectional view taken from FIG. 5.

Molded plastic indicator arm 60 adapted to be mounted for horizontal rotation on post 40 and held in position by pivot pin 50, is shown in FIG. 3. Specifically, indicator arm 60 has at one end 61 a substantially horizontal flat cylindrical collar 62 by which it is secured. Collar 62 has an inner diameter smaller than the outer diameter of post 40 and larger than the diameter of shank 51 of pivot pin 50. As shown in FIG. 4, indicator arm 60 also has a semi-cylindrical enclosure 63 for spring 90 adjacent collar 62, two horizontal opposed slide rails 64 for yoke 80 and distance indicator 70 adjacent enclosure 63, and a loop 65 for cord 101 at end 66. In the length of indicator arm 60 between slider rails 64 and loop 65, indicator arm 60 passes through slot 42 in body 22, as noted above, and extends beyond front wall 25 under base 24, as shown in FIG. 11. Loop 65 is a substantially vertical loop.

Figure 7:
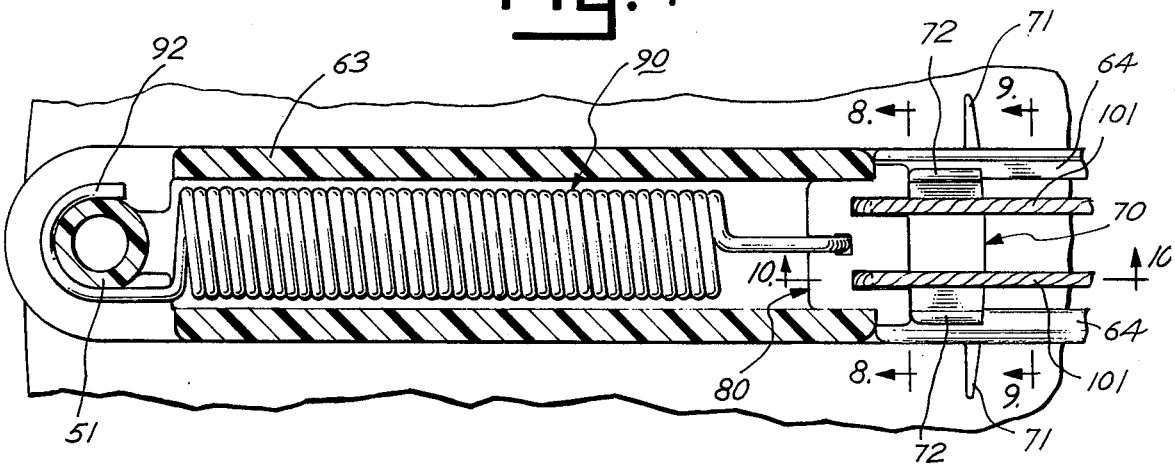
FIG. 7 is a partial horizontal cross-sectional view of the device taken along lines 7—7 of FIG. 5.

As shown in FIG. 7, molded plastic distance indicator 70 is adapted to fit between slide rails 64 of indicator arm 60, and has flanges 72 resting on slide rails 64. Distance indicator 70 is thus freely slidable along slide rails 64. Pointers 71, which extend outward, provide for easy reading of distance markings 130.

Figure 2:
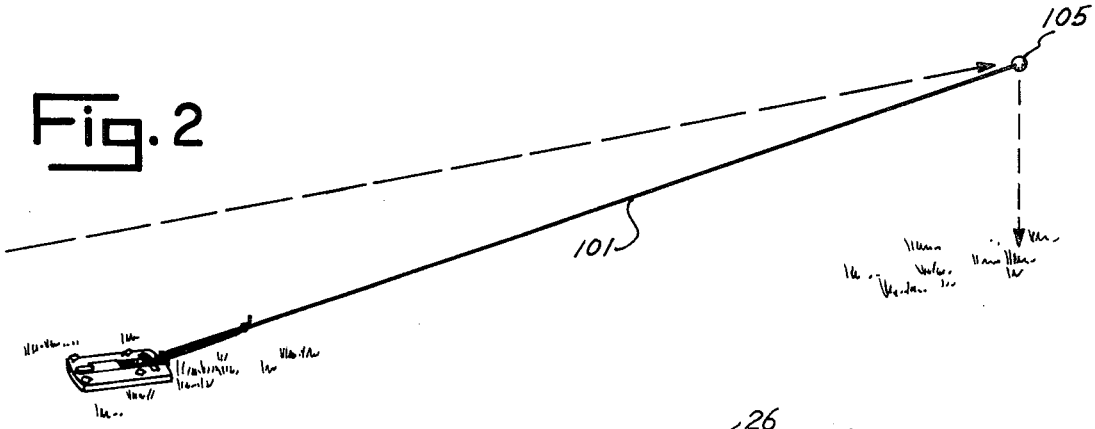
FIG. 2 is a perspective view showing the ball in flight in front of the base with the cord pulled taut.
Figure 8:
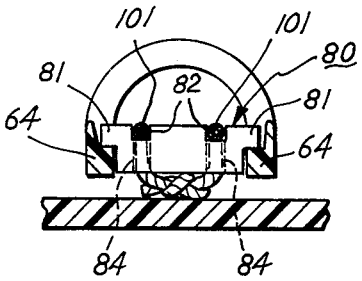
FIG. 8 is a partial vertical cross-sectional view taken along lines 8—8 of FIG. 7.

As shown in FIG. 8 and noted above, yoke 80 is also mounted on slide rails 64, by flanges 81. Channels 82 on the upper surface 83 thereof and vertical holes 84 receive cords 101, which are tied together under yoke 80. As shown in FIGS. 3 and 11, cords 101 are passed through loop 65 of indicator arm 60 and again tied. One of said cords 101 has a great length in comparison with the length of indicator arm 60, and as shown in FIGS. 1 and 2, golf ball member 105 is attached to its other end.

Figure 9:
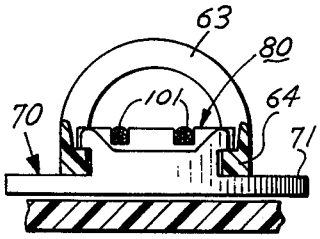
FIG. 9 is a partial vertical cross-sectional view taken along line 9—9 of FIG. 7.
Figure 10:
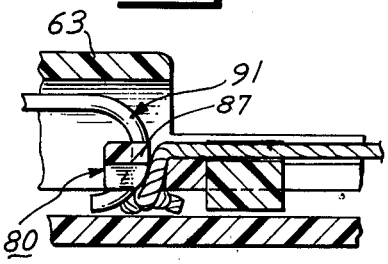
FIG. 10 is a partial vertical cross-sectional view taken along line 10—10 of FIG. 7.

Referring now to FIGS. 9 and 10, helical spring 90, positioned within enclosure 63 of indicator arm 60, is shown. Yoke 80 has a vertical opening 87 and spring 90 has an end 91 adapted to fit in that vertical opening. Other end 92 of spring 90 is adapted to fit around shank 51 of pivot pin 50. Spring 90 thus is secured at end 92 to the base and biases yoke 80 toward post 40. Spring 90 is chosen to have a force constant suitable for the chosen length of slide rails 64 and cord 101. This is done because the length of slide rails 64 determines the range of distance within which distance indicator 70 can be pushed by the stretch of spring 90, and cord 101 determines the range of force which will be applied to spring 90, since the energy of golf ball member 105 when it pulls spring 90 depends on the distance it has travelled from the tee.

Angle indicator 120 is shown in FIG. 3 and is adapted to fit over loop 65 of arm 60. More specifically, angle indicator 120, as shown in FIGS. 11 and 12, has a generally rectangular body portion 121 and a pointer portion 122 which lies in a horizontal plane above base 24. A vertical mating rib 128 is integrally molded on the face 127 of body portion 122 which faces front wall 25. As stated above, ribs 44 and rib 128 cooperate to releasably lock arm 60. That is, rib 128 is engaged between two of ribs 44 when arm 60 is at rest. By lifting angle indicator 120, mating rib 128 can be disengaged from ribs 44 and thus arm 60 may pivot until angle indicator 120 is no longer lifted. Angle indicator 120 is held on arm 60 by cords 101, which pass through loop 65 of indicator arm 60 above angle indicator 120.

The improved golf practice device thus described may be easily and readily used by any golfer. First a circular area clear of objects which has a radius at least equal to the free length of the cord is chosen. Then the body 22 is secured to the ground by hammering pegs 36 into the ground through apertures 34. The indicator arm 60 is set at zero angle by lifting the arm to disengage mating rib 128 on angle indicator 120 from ribs 38 on body 22 and moving it to zero. Distance indicator 70 is slid along slide rails 64 to abut yoke 80, and ball 105 is placed directly behind the machine and teed up at a distance which leaves little slack in the cord. The golfer may then practice his or her swing by hitting ball 105 over the machine.

The ball is driven to the position shown in FIG. 2 where its flight is arrested. The ball pulls yoke 80 against the tension of spring 90, sliding distance indicator 70 along slide rails 64. The ball also pulls arm 60 up, disengaging the ribs, and moves it to the angle to which the ball is flying. Once the ball drops to the ground, along the path depicted by the dashed line in FIG. 2, the golfer may approach the base and read the distance and angle his or her drive would have gone if the ball were free flying. The ball may be retrieved by pulling on the cord and the golfer can then set the device for his or her next drive.

From the foregoing, it should be apparent to those having skill in the art that the improved golf practice device affords a novel and useful device by which a golfer may practice both tee and fairway shots. As noted above, all of the components of the improved golf practice device 20, except the pegs 36, the spring 90, the cord 101 and the ball 105, can be made from a plastic material of the type which can be readily molded. Polyethylene is one such material. Thus the improved device 20 may be relatively inexpensively manufactured because substantially all of its component parts can be of molded plastic construction. Not only does the use of such molded plastic components decrease the manufacturing costs, but it also greatly enhances the appearance of the device, thereby giving the device widespread customer appeal.

Finally, various modifications and changes can be made in the structure or design of my improved golf practice device 20 as described hereinabove. In other words, the improved golf practice device 10 disclosed herein may be embodied in other specific forms without departing from the spirit or central characteristics of my invention. Thus the preferred embodiment of my improved golf practice device 20 is to be considered in all respects as illustrative and not restrictive. The scope of my invention is indicated by the appended claims, rather than by the foregoing description. All changes which come within the meaning and range of equivalence of the claims are intended to be embraced therein.

What is claimed is:

1. An improved portable golf practice device comprising, in combination:

a body including a substantially flat horizontal base which has an upper and lower surface, front, rear and side walls extending downwardly from said base, a post which projects upwardly through said upper surface of said base and downwardly through said lower surface of said base to a distance less than that of said walls of said body, said post disposed so that its central longitudinal axis is substantially equidistant from said side walls of said body and adjacent said rear wall of said body and substantially perpendicular to the planes of said surfaces of said base, said base having a plurality of apertures spaced about the periphery thereof adapted to receive pegs which are to be driven into the ground for securing said body to the ground;

a pivot pin having a cylindrical shank and a cap, said shank being sized to fit within the post of said body and having a length greater than that of said post, said cap being greater in diameter than said shank;

an indicator arm including a substantially horizontal collar at one end, an enclosure adjacent said collar being disposed so that its longitudinal axis is horizontal, two horizontally opposed slide rails adjacent said enclosure and parallel thereto, and a loop, said collar having an inner diameter less than the diameter of said cap of said pivot pin, said loop being disposed substantially in a vertical plane substantially perpendicular to the longitudinal axis of said enclosure of said indicator arm, said indicator arm being pivotally secured to said post of said body by said pivot pin;

a slidable yoke having a central section, opposed side sections and flanges on each of said side sections, said flanges slidably securing said yoke between said slide rails of said indicator arm;

a helical spring having one end secured about said shank of said pivot pin between said cap of said pivot pin and said collar of said indicator arm and having another end secured to said yoke, said helical spring being adapted to fit within said enclosure of said indicator arm;

a distance indicator having a central portion, opposed side portions and vertically spaced flanges on each of said opposed side sections, said flanges securing said distance indicator between said slide rails of said indicator arm;

cord attached at one end to said yoke passing through said loop at the end of said indicator arm, said cord being a length great in comparison with the length of said indicator arm; and a golf ball secured to said cord at its other end.

2. The improved golf practice device of claim 1 in which said base has a slot adjacent said front wall of said body, said slot being curved along arcs of circles having centers located along said central longitudinal axis of said post of said body;

said indicator arm having a section between the slide rails and the loop which extends downward through the slot and horizontally beyond the front wall of the base, said loop extending upward therefrom to a distance above the upper surface of the base.

3. The improved golf practice device of claim 2 in which said front wall of said base is curved along an arc of a circle having its center located along said central longitudinal axis of said post said device further comprising:

an angle indicator slidable vertically on said loop of said arm;

a plurality of vertical ribs spaced along the front wall of said body; and a mating vertical rib on said angle indicator facing said ribs spaced along the front wall of said body;

said angle indicator being movable vertically to engage and disengage said mating vertical rib from said vertical ribs.

* * * * *